US005244155A

United States Patent [19]

Klimpel et al.

[11] Patent Number: 5,244,155

[45] Date of Patent: Sep. 14, 1993

[54] SOLID-SOLID SEPARATIONS UTILIZING ALKANOL AMINES

[75] Inventors: Richard R. Klimpel, Midland, Mich.; Basil S. Fee, Sarnia, Canada; Donald E. Leonard, Shepherd, Mich.

[73] Assignee: The Dow Chemical Company, Midland, Mich.

[21] Appl. No.: 719,903

[22] Filed: Jun. 24, 1991

[51] Int. Cl.[5] ..... B03B 1/00

[52] U.S. Cl. ..... 241/20; 241/24; 209/4; 209/9; 209/127.1; 209/214; 209/211; 209/422; 209/459; 494/37

[58] Field of Search ..... 209/4, 5, 9, 3, 211, 209/459, 233, 269, 422, 162, 208, 214, 166, 127.1; 241/16, 24, 20; 494/37

[56] References Cited

U.S. PATENT DOCUMENTS

| | | | |
|---|---|---|---|
| 2,014,405 | 9/1935 | Weed | 209/166 |
| 2,014,406 | 9/1935 | Weed | 209/166 |
| 3,443,976 | 5/1969 | Dodson | 241/16 |
| 3,608,836 | 9/1971 | Bryant | 241/16 |
| 4,162,044 | 7/1979 | Manfroy | 241/16 |
| 4,162,045 | 7/1979 | Katzer | 241/16 |
| 4,226,672 | 10/1980 | Absolon | 209/5 |
| 4,274,599 | 6/1981 | Manfroy | 241/16 |
| 5,057,209 | 10/1991 | Klimpel | 209/166 |
| 5,124,028 | 6/1992 | Klimpel | 209/166 |
| 5,131,600 | 7/1992 | Klimpel et al. | 241/16 |

FOREIGN PATENT DOCUMENTS

| | | | |
|---|---|---|---|
| 298367 | 12/1990 | Japan | 241/16 |
| 1586778 | 8/1990 | U.S.S.R. | 241/16 |

*Primary Examiner*—Thomas M. Lithgow

[57] ABSTRACT

The separation of silica or siliceous gangue from one or more desired minerals in an aqueous slurry via mechanical apparatus is improved by the addition of a small amount of an alkanol amine to the slurry. Examples of separation techniques benefiting from this technology include cyclones, tables and spiral separators.

10 Claims, No Drawings

SOLID-SOLID SEPARATIONS UTILIZING ALKANOL AMINES

BACKGROUND OF THE INVENTION

This invention relates to the selective separation of certain solids from solid mixtures containing silica or siliceous gangue.

The processing of mixed solids in particulate form is widely practiced in industry. The solids are usually separated into individual components (solid/solid separation) by a variety of engineering processes using inherent differences between the various solid components. These inherent differences include color, size, conductivity, reflectance, density, magnetic permeability, electrical conductivity and surface wettability. This latter characteristic, surface wettability, is exploited in froth flotation, flocculation and agglomeration processes which rely heavily on various chemical treatments to enhance separation.

Differences in the other characteristics identified above, especially size, conductivity, density, magnetic permeability and electrical conductivity, have typically been utilized to obtain separation via various mechanical methods. These methods include the use of screening, wet cyclones, hydroseparators, centrifuges, heavy media devices, desliming vessels, jigs, wet tables, spirals, magnetic separators and electrostatic separators. The proper use of water is recognized as critical to the efficiency of such methods. A fundamental driving force in most of these operations is the control of how particles flow, settle or are magnetically or electrically manipulated in an aqueous environment. Factors such as the density (percent solids by weight) of the solid mixture solutions in water; the degree of mechanical agitation of such pulps; the size of particles in the solid mixtures; and the equipment design and size all act and/or are controlled in a complex fashion to optimize the appropriate solid separation in any specific operation. While some universal scientific and engineering concepts can be applied in such separations, the complexity of such operations frequently requires empirical testing and adjustment to effect a suitable separation.

One area that is well recognized as a requirement of equipment optimization is the proper dispersion of the individual solid particles of the mixtures being fed to such physical separation devices. Separation efficiency drops dramatically when the solid mixture (pulp) is too dense. Conversely, when the percentage of solids is too low, the separation of components may be good, but the solids feed is too small per unit of equipment size to be economically viable.

The role of chemicals in these mechanical separation processes is relatively small. Chemicals that have been used include pH regulators such as caustic and lime; flooculents such as high molecular weight acrylamides; and dispersants such as sodium silicate and polyacrylic acid polymers. The effect of these additives has generally been sporadic and has varied between positive and negative depending on the equipment used, small variations in the dosage, the nature of the solid feed mixtures and so on. The use of such chemicals has not been generally adopted due to the relatively high levels needed and uncertain effects obtained.

There thus remains a need for a consistent, easily applied and economically feasible method to enhance mechanical separation techniques either through enhanced component separation or increased throughput.

SUMMARY OF THE INVENTION

In a solid/solid separation process wherein an aqueous slurry of solids containing silica or siliceous gangue and one or more desired minerals is mechanically separated, the improvement comprising the addition of an amount of an alkanol amine to the aqueous slurry effective to modify the interaction of the silica or siliceous gangue with the aqueous medium such that separation of the silica or siliceous gangue from the remainder of the solid minerals is enhanced.

It is surprising that mechanical processes for the separation of solid/solid mixtures containing silica or siliceous gangue can be improved by the addition of small amounts of alkanol amines.

DETAILED DESCRIPTION OF THE ILLUSTRATIVE EMBODIMENTS

When used in the context of the present invention, mechanical separation refers to those methods in which an aqueous slurry of solid particles is separated based on the physical characteristics of the particles. Such physical characteristics include size, conductivity, density, magnetic permeability and electrical conductivity.

Typical means used to separate solid/solid pulps include jigs, wet tables, spirals, heavy media devices, screening, wet cyclones, hydroseparators, centrifuges, desliming vessels, magnetic separators and electrostatic separators. These techniques are well known in the art and are extensively practiced. A general discussion of these techniques is found in Perry's Chemical Engineers' Handbook, Sixth Edition, edited by Don W. Green McGraw-Hill Book Company.

The typical manner of practicing these methods of mechanical separation is not modified by the practice of this invention, other than by the addition of the alkanol amine.

Typically, mechanical separation is used to separate particulate solids with sizes ranging from about 100 millimeters (mm) in diameter down to particles of less than 0.001 mm in diameter. Particles of this size range may be obtained in various ways, but are typically obtained by wet grinding. Once ground, the particles are present in an aqueous slurry ranging from 2 to 70 percent by weight solids depending on various factors such as the particular method of solid separation used and other related operating conditions.

The alkanol amines of the present invention preferably correspond to the formula $$NR^1R^2R^3$$

Wherein $R^1$, $R^2$ and $R^3$ are individually in each occurrence hydrogen or a $-C_{(1-6)}$ hydroxy alkyl moiety. Preferred alkanol amines are monoethanolamine, diethanolamine, triethanolamine, isopropanolamine, hexanolamine and mixtures thereof. The most preferred alkanolamine is diethanolamine. It will be recognized by those skilled in the art that commercial methods of production of such compounds as diethanolamine result in a product containing some by-products such as other alkanol amines. Such commercial products are operable in the practice of the present invention. It will also be recognized that the alkanol amines are themselves compounds and do not form a part of a larger molecule.

The amount of such alkanol amines used in the process of this invention is that which is effective to result in increased recovery of the desired solid either through improved grade, improved recovery or a combination thereof. This amount typically ranges from 0.01 to 10 kilogram of alkanol amine per metric ton of dry feed. Preferably, the amount ranges from 0.05 to 1 kg per metric ton and more preferably from 0.1 to 0.5 kg per metric ton.

The alkanol amine is added to the aqueous slurry feed prior to the feed being fed to the separation device. It is preferred that, when the solid feed is subjected to grinding that the alkanol amine be added to the grinding step.

EXAMPLE 1

Magnetic Separation

A continuous 12 inch diameter by 7 inch width wet drum magnetic separator (ERIEZ Laboratory Model 500-11-11) is set up to run at twenty-five percent of maximum intensity using 115 volts and 5.2 amp input. Several batches of feed material are prepared using a mixture of magnetite with a specific gravity of 3.96 and silica with a specific gravity of 2.67. The feed mixture of particles is 15.5 weight percent magnetite. The feed mixtures were prepared in aqueous slurry form at 20 weight percent solids in a special highly agitated slurry holding tank that provides a uniform feed slurry to the magnetic separator. In one run, no pre-treatment is used and in the second run, the slurry is treated with diethanolamine in an amount equivalent to 0.45 kg per metric ton of dry feed solids. Each run is operated at steady state conditions and samples are collected from the concentrate, overflow and tail for five minutes. The samples are dried, weighed and an iron analysis is done with a D.C. plasma spectrometer to determine that fate of the magnetite. The results obtained are shown in Table I below.

TABLE I

| | Sampling Point | Fractional Wt. Split | Grade of Fe in Sample | Fractional Recovery of Fe in Sample |
|---|---|---|---|---|
| Comparison Run① | Concentrate | 0.328 | 0.423 | 0.874 |
| | Overflow | 0.034 | 0.006 | 0.001 |
| | Tail | 0.638 | 0.031 | 0.125 |
| DEA Run | Concentrate | 0.292 | 0.482 | 0.925 |
| | Overflow | 0.035 | 0.001 | 0.000 |
| | Tail | 0.673 | 0.017 | 0.075 |

①Not an embodiment of the invention

The data above shows that the addition of diethanolamine results in more iron being recovered in the concentrate and less iron lost in the tailings.

EXAMPLE 2

A two foot by four foot laboratory table separator is used with 0.5 inch openings between the ribs and ribs of 0.125 by 0.068 inches. The table angle is 10 degrees from horizontal with moderate agitation and water washing. The feed material used is 15.5 weight percent magnetite with the remainder silica. The same slurry feeding system is used and all table operating conditions and slurry feed rates are held constant in each run. Two steady state runs were made at 20 weight percent solids in an aqueous slurry. Sampling of product, middlings and tail were made for seven minutes in each run. All samples were dried, weighed and analyzed for iron using a D.C. plasma spectrometer. The definition of samples with this table is defined by the physical placement of overflow trays. The results obtained are shown in Table II below.

TABLE II

| | Sampling Point | Fractional Wt. Split | Grade of Fe in Sample | Fractional Recovery of Fe in Sample |
|---|---|---|---|---|
| Comparison Run① | Product | 0.213 | 0.359 | 0.493 |
| | Meddlings | 0.276 | 0.148 | 0.264 |
| | Tail | 0.511 | 0.074 | 0.244 |
| DEA Run | Product | 0.233 | 0.378 | 0.568 |
| | Meddlings | 0.117 | 0.178 | 0.134 |
| | Tail | 0.650 | 0.071 | 0.298 |

①Not an embodiment of the invention

The data above shows a significant increase in the amount of iron recovered. The primary effect appears to be in the shift of iron from the middlings to the product.

EXAMPLE 3

Samples of specified ores (300 g each) are ground in an eight inch diameter ball mill using one inch diameter stainless steel balls to obtain approximately 50 weight percent less than 37 micrometers in diameter. The mill is rotated at 60 revolutions per minute (RPM) and 600 $cm^3$ of water is added along with any desired chemical to the mill before grinding was initiated. When the target grind size is achieved, the mill contents are transferred to a 10 liter vessel and the contents are diluted with water to make up a total pulp volume of 10 liters. The dilute pulp is mixed for one minutes at 1800 RPM and then settling is allowed to occur for five minutes. Then seven liters of the pulp from the upper zone of the vessel are decanted. The dry weights of both the decanted solids and the settled solids are recorded and the weight percent in the deslimed fraction is calculated. The higher this deslime weight fraction, the more efficient the desliming or fine particle removal process.

The three ores chosen are an iron ore containing 32 weight percent silica: a copper ore containing 76 weight percent silica and siliceous gangue and a phosphate ore containing 44 weight percent silica and siliceous gangue. The identity and dosage of the alkanol amines used is shown in Table III below.

TABLE III

| Alkanol Amine | Dosage (kg/met ton) | Weight % of Solids Removed | | | % $SiO_2$ in Solids Removed | | |
|---|---|---|---|---|---|---|---|
| | | Iron Ore | Copper Ore | Phosphate Ore | Iron Ore | Copper Ore | Phosphate Ore |
| None① | — | 13.4 | 6.2 | 18.5 | 80.4 | 88.1 | 50.9 |
| Monoethanolamine | 0.225 | 15.7 | 10.4 | 24.8 | 81.9 | 91.1 | 56.4 |
| | 0.45 | 21.5 | 12.5 | 28.1 | 85.6 | 92.0 | 59.3 |
| Diethanolamine | 0.045 | 14.4 | 7.3 | 21.0 | 81.3 | 89.3 | 53.5 |
| | 0.113 | 16.7 | 9.7 | 22.7 | 83.5 | 90.5 | 54.3 |
| | 0.225 | 21.3 | 12.2 | 29.3 | 86.0 | 93.7 | 57.0 |
| | 0.45 | 24.7 | 14.8 | 35.0 | 87.1 | 95.1 | 63.6 |
| | 0.90 | 26.7 | 15.9 | 38.6 | 88.4 | 96.0 | 66.2 |
| Triethanolamine | 0.45 | 17.4 | 8.4 | 23.5 | 82.2 | 90.1 | 55.9 |

TABLE III-continued

| Alkanol Amine | Dosage (kg/met ton) | Weight % of Solids Removed | | | % $SiO_2$ in Solids Removed | | |
|---|---|---|---|---|---|---|---|
| | | Iron Ore | Copper Ore | Phosphate Ore | Iron Ore | Copper Ore | Phosphate Ore |
| Isopropanolamine | 0.45 | 20.6 | 9.3 | 25.1 | 84.3 | 90.5 | 56.8 |
| Hexanolamine | 0.45 | 18.0 | 8.8 | 23.7 | 82.9 | 90.3 | 56.0 |

①Not an embodiment of the invention

The data in Table III shows that various alkanol amines are effective in increasing the percentage of very fine particles removed in a desliming process. As in this example, the very fine (high surface area) particles present in many finely ground mineral samples are rich in undesired silica and/or siliceous gangue. Their removal is important in subsequent treatment steps involving the addition of chemical reagents such as in flotation.

EXAMPLE 4

A standard five turn Humphrey spiral is set up with constant feed pulp and feed water capability. Only one concentrate port is used (remainder are sealed off with smooth discs) to obtain consistent steady-state conditions. Sufficient wash water is supplied to maintain a reasonably smooth flow pattern over the concentrate port which is located at the bottom of the first spiral turn. Each run described in Table IV below consists of a five-minute sampling period with the feed rate being 3.0 kg of a 20 weight percent solid slurry over the five minute period. Four different ores were used: (1) cassiterite ($SnO_2$) containing 0.65 weight percent tin with 1.2 weight percent larger than 10 mesh and 9.9 weight percent smaller than 200 mesh; (2) coarse hematite ($FeO_3$) containing 33.1 weight percent iron with 8.6 weight percent being larger than 10 mesh and 2.1 weight percent being smaller than 200 mesh: (3) fine hematite containing 47.4 weight percent iron with 0.0 weight percent being larger than 10 mesh and 28.3 weight percent being smaller than 200 mesh: and (4) coarse rutile ($TiO_2$) containing 8.8 weight percent iron with 11.4 weight percent being larger than 10 mesh and 4.9 weight percent being smaller than 200 mesh. In each run, all samples are collected, dried and weighed and metal content is determined by a D. C. plasma spectrograph. When the diethanolamine was used, the feed slurry was conditioned for one minute in a stirred tank before slurry feed addition to the spiral was initiated. The results obtained are shown in Table IV below.

TABLE IV

| Ore | Wt % Ore Recovered | | Grade of Recovered Ore | | % of Metal Recovered | |
|---|---|---|---|---|---|---|
| | No DEA | DEA | No DEA | DEA | No DEA | DEA |
| $SnO_2$ | | | | | | |
| Concentrate | 34.1 | 39.6 | 1.34 | 1.32 | 70.3 | 80.4 |
| Tail | 65.9 | 60.4 | 0.29 | 0.21 | 29.4 | 19.5 |
| Course $Fe_2O_3$ | | | | | | |
| Concentrate | 38.0 | 35.4 | 38.1 | 45.0 | 43.7 | 48.1 |
| Tail | 62.0 | 64.6 | 30.1 | 26.5 | 56.4 | 51.7 |
| Fine $Fe_2O_3$ | | | | | | |
| Concentrate | 50.3 | 56.8 | 53.7 | 53.1 | 57.0 | 63.6 |
| Tails | 49.7 | 43.2 | 41.0 | 40.0 | 43.0 | 36.4 |
| Rutile | | | | | | |
| Concentrate | 11.0 | 10.1 | 41.7 | 50.1 | 52.125 | 57.5 |
| Tails | 89.0 | 89.9 | 4.7 | 4.2 | 47.5 | 42.9 |

The data above shows that, in each case, the overall recovery of the desired metal is increased by the practice of the present invention.

EXAMPLE 5

Hydrocyclone Separation

A one inch hydrocyclone unit having a constant feed slurry pumping device is used. Steady state feed conditions and a uniform discharge fan are established prior to sampling the underflow and overflow discharge. The feed slurry of hematite ore contains 34.6 weight percent $SiO_2$ and is about 6 weight percent solids. When used, the alkanol agitated to insure uniform feed to the cyclone. Samples are sized on standard U.S. screens to detect any shift in separation efficiency. The results obtained are shown in Table V below.

TABLE V

| Alkanolamine | Dosage (kg/met ton) | Underflow | | Overflow | | |
|---|---|---|---|---|---|---|
| | | % Total Weight | % ≦ 200 US Mesh | % Total Weight | % ≦ 400 US Mesh | % SiO2 |
| None① | — | 86.9 | 80.5 | 13.1 | 60.1 | 70.3 |
| Diethanolamine | 0.45 | 82.6 | 81.1 | 17.4 | 63.4 | 75.4 |
| Diethanolamine | 0.90 | 81.1 | 81.9 | 18.9 | 64.7 | 78.7 |
| Monoethanolamine | 0.90 | 83.5 | 80.9 | 16.5 | 62.7 | 73.5 |

①Not an embodiment of the invention.

EXAMPLE 6

Hydrocyclone Separation

The process described in Example 5 is used with the exception that the ore used is a phosphate ore containing 58.1 weight percent $SiO_2$. The results obtained are shown in Table VI below.

TABLE VI

| Alkanolamine | Dosage (kg/met ton) | Underflow % Total Weight | Underflow % ≦ 200 US Mesh | Overflow % Total Weight | Overflow % ≦ 400 US Mesh | % SiO2 |
|---|---|---|---|---|---|---|
| None① | — | 89.7 | 90.4 | 10.3 | 84.5 | 60.04 |
| Diethanolamine | 0.45 | 86.3 | 92.3 | 13.7 | 86.0 | 63.7 |
| Monoethanolamine | 0.45 | 88.4 | 91.1 | 11.6 | 84.9 | 62.3 |

①Not an embodiment of the invention.

The data in Tables V and VI show that the use of the alkanol amines increases the amount of silica containing fines removed from the two ores tested. It is also clear that while the weight percent of material included in the coarse underflow decreases slightly, the percentage of that material which is of the desired larger particle size increases.

EXAMPLE 7

Viscosity Effects on Silica Slurries

An aqueous silica slurry containing 60 weight percent solids and 82.4 weight percent less than 200 U.S. mesh is prepared. The samples are well mixed and then viscosity is measured using a Brookfield RVT viscometer with a T-bar and helipath stand. The samples are allowed to stand undisturbed for 24 hours after viscosity measurements are taken and then the height of the solid rich lower zone is measured. The data obtained is shown in Table VII below.

TABLE VII

| Alkanolamine | Dosage kg/metric ton | Viscosity (cps × 100) | Height of Solid Zone (cm) |
|---|---|---|---|
| None | — | 46 | 8.9 |
| Diethanolamine | 0.45 | 50 | 11.3 |
| | 0.90 | 55 | 13.7 |
| | 2.00 | 62 | 15.4 |
| Monoethanolamine | 0.45 | 49 | 10.5 |
| Isopropanolamine | 0.45 | 48 | 10.1 |
| Hexanolamine | 0.45 | 47 | 9.6 |
| Triethanolamine | 0.45 | 47 | 9.3 |

The data in Table VII shows that the alkanol amines of the present invention have a general effect on the viscosity of aqueous silica slurries and on the rate or degree of settling of the silica particles when left undisturbed. The alkanol amine appears to keep the fined silica particles in suspension to a greater degree.

What is claimed is:

1. In a solid/solid separation process wherein an aqueous medium and solids together form an aqueous slurry of solids, said solids containing silica or siliceous gangue and one or more desired minerals, said separation includes mechanically separating said silica or siliceous gangue from said one or more desired minerals, said separation being based on inherent differences in one or more of the solids' properties of color, size, conductivity, reflectance, density, magnetic permeability and electrical conductivity, the improvement comprising the addition of an alkanol amine, corresponding to the formula $$NR^1R^2R^3$$

wherein $R^1$, $R^2$ and $R^3$ are individually in each occurrence hydrogen or a $C_{(1-16)}$ hydroxy alkyl moiety with at least one of $R^1$, $R^2$ and $R^3$ being a $C_{(1-16)}$ hydroxy alkyl moiety, to the aqueous slurry in an amount effective to modify the interaction of the silica or siliceous gangue with the aqueous medium such that the separation of the silica or siliceous gangue from the one or more desired minerals in enhanced.

2. The process of claim 1 wherein the alkanol amine is selected from the group consisting of diethanolamine, monoethanolamine and mixtures thereof.

3. The process of claim 1 wherein the solids contained in the aqueous slurry are subjected to a grinding step prior to being mechanically separated.

4. The process of claim 3 wherein the alkanol amine is added to the grinding step.

5. The process of claim 4 wherein the alkanol amine is selected from the group consisting of diethanolamine, monoethanolamine and mixtures thereof.

6. The process of claim 1 wherein the solid/solid separation process uses wet tables.

7. The process of claim 1 wherein the solid/solid separation process uses desliming vessels.

8. The process of claim 1 wherein the solid/solid separation process uses hydroseparators.

9. The process of claim 1 wherein the alkanolamine is used in an amount of from 0.01 to 10 kilograms of alkanolamine per metric ton of dry solids fed to the separation.

10. The process of claim 1 in which the solid/solid separation process uses jigs, wet tables, spirals, heavy media devices, screening, wet cyclones, hydroseparators, centrifuges, desliming vessels, magnetic separators or electrostatic separators.

* * * * *